US006427483B1

(12) United States Patent
Rashad et al.

(10) Patent No.: US 6,427,483 B1
(45) Date of Patent: Aug. 6, 2002

(54) CRYOGENIC INDUSTRIAL GAS REFRIGERATION SYSTEM

(75) Inventors: Mohammad Abdul-Aziz Rashad, Kenmore; Bayram Arman, Grand Island; Arun Acharya, East Amherst, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/986,524

(22) Filed: Nov. 9, 2001

(51) Int. Cl.[7] ..... F25J 1/02
(52) U.S. Cl. ..... 62/613; 62/614
(58) Field of Search ..... 62/51.2, 606, 613, 62/614, 612, 615, 616

(56) References Cited

U.S. PATENT DOCUMENTS

| | | | | |
|---|---|---|---|---|
| 3,763,658 A | | 10/1973 | Gaumer, Jr. et al. | 62/40 |
| 4,274,849 A | | 6/1981 | Garier et al. | 62/9 |
| 5,580,426 A | * | 12/1996 | Ganeshan | 203/2 |
| 5,657,643 A | | 8/1997 | Price | 62/612 |
| 6,041,620 A | | 3/2000 | Olszewski et al. | 62/612 |
| 6,041,621 A | | 3/2000 | Olszewski et al. | 62/613 |
| 6,053,008 A | | 4/2000 | Arman et al. | 62/646 |
| 6,065,305 A | | 5/2000 | Arman et al. | 62/613 |
| 6,076,372 A | | 6/2000 | Archarya et al. | 62/606 |
| 6,105,388 A | | 8/2000 | Archarya et al. | 62/612 |
| 6,119,479 A | | 9/2000 | Roberts et al. | 62/612 |
| 6,253,574 B1 | * | 7/2001 | Stockmann | 62/612 |

* cited by examiner

*Primary Examiner*—Denise L. Esquivel
*Assistant Examiner*—Malik N. Drake
(74) *Attorney, Agent, or Firm*—Stanley Ktorides

(57) ABSTRACT

A method and apparatus for refrigerating and, if desired, liquefying an industrial gas wherein a multicomponent refrigerant fluid is used to generate refrigeration in a single circuit which includes a single phase separation and recycle after an initial heat exchange stage.

7 Claims, 2 Drawing Sheets

CRYOGENIC INDUSTRIAL GAS REFRIGERATION SYSTEM

TECHNICAL FIELD

This invention relates generally to the refrigeration and preferably liquefaction of industrial gas and is particularly useful for bringing the gas from ambient temperature to a cryogenic temperature to effect the refrigeration.

BACKGROUND ART

The refrigeration of industrial gases is an important step which is used in many industrial operations. Typically the industrial gas is refrigerated and optionally liquefied by indirect heat exchange with a refrigerant. Such a system, while working well for providing refrigeration over a relatively small temperature range from ambient, is not as efficient when refrigeration over a large temperature range, such as from ambient to a cryogenic temperature, is required. One way this inefficiency has been addressed is to use a refrigeration scheme with multiple circuits wherein each circuit serves to reduce the temperature of the industrial gas until the requisite temperature is reached. However, such multiple circuit industrial gas refrigerators may be complicated to operate.

A conventional single circuit refrigerator or liquefier system is much less complicated than a multiple circuit refrigerator liquefier but such a system imposes very stringent requirements on the selection of the refrigerant. A recent significant advancement in the field of industrial gas liquefaction is the use of a multicomponent refrigerant fluid instead of the single component refrigerant conventionally used in cooling or liquefying circuits. However, even with the use of a multicomponent refrigerant fluid in a single circuit system, it is costly to carry out the cooling over a large temperature range, such as from ambient temperature to a cryogenic temperature as would be necessary for the liquefaction of an industrial gas, because of the equipment and process steps needed to ensure that one or more components of the refrigerant or other matter such as equipment lubricant does not freeze at the lower temperatures.

Accordingly, it is an object of this invention to provide an improved system for refrigerating an industrial gas, which employs a multicomponent refrigerant fluid.

SUMMARY OF THE INVENTION

The above and other objects, which will become apparent to those skilled in the art upon a reading of this disclosure, are attained by the present invention, one aspect of which is:

An industrial gas refrigerator comprising:

(A) A multistage heat exchanger comprising an initial stage and a final stage;

(B) means for passing industrial gas through the multistage heat exchanger, and means for recovering refrigerated industrial gas from the final stage of the multistage heat exchanger;

(C) means for passing multicomponent refrigerant fluid through the initial stage of the multistage heat exchanger;

(D) a phase separation device having a vapor exit, and means for passing multicomponent refrigerant fluid from the initial stage of the multistage heat exchanger to the phase separation device; and (E) means for withdrawing multicomponent refrigerant fluid from the vapor exit of the phase separation device, and means for passing essentially all of the fluid withdrawn from said vapor exit of the phase separation device to the final stage of the multistage heat exchanger.

Another aspect of the invention is:

A method for refrigerating industrial gas comprising:

(A) providing a multistage heat exchanger comprising an initial stage and a final stage;

(B) passing multicomponent refrigerant fluid through the initial stage of the multistage heat exchanger and withdrawing multicomponent refrigerant fluid in both a vapor phase and a liquid phase from the initial stage of the multistage heat exchanger;

(C) passing the multicomponent refrigerant fluid withdrawn from the initial stage of the multistage heat exchanger to a phase separation device having a vapor exit;

(D) withdrawing multicomponent refrigerant fluid from the vapor exit of the phase separation device and passing essentially all of the fluid withdrawn from the vapor exit of the phase separation device to the final stage of the multistage heat exchanger; and (E) passing industrial gas through the multistage heat exchanger and recovering refrigerated industrial gas from the final stage of the multistage heat exchanger.

As used herein the term "subcooling" means cooling a liquid to be at a temperature lower than saturation temperature of that liquid for the existing pressure.

As used herein the term "normal boiling point" means the boiling temperature at 1 standard atmosphere pressure, i.e. 14.696 pounds per square inch absolute.

As used herein the term "indirect heat exchange" means the bringing of fluids into heat exchange relation without any physical contact or intermixing of the fluids with each other.

As used herein the term "expansion" means to effect a reduction in pressure.

As used herein the terms "turboexpansion" and "turboexpander" means respectively method and apparatus for the flow of high pressure fluid through a turbine to reduce the pressure and the temperature of the fluid thereby generating refrigeration.

As used herein the term "variable load refrigerant" means a mixture of two or more components in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the practice of this invention the temperature differences between the bubble point and the dew point for the variable load refrigerant is at least 10° K., preferably at least 20° K. and most preferably at least 50° K.

As used herein the term "industrial gas" means a fluid having a normal boiling point of 150° K. or less. Examples of industrial gases include nitrogen, oxygen, argon, hydrogen, helium, carbon dioxide, carbon monoxide, methane and fluid mixtures containing one or more thereof.

As used herein the term "cryogenic temperature" means a temperature of 150° K. or less.

As used herein the term "refrigeration" means the capability to reject heat from a subambient temperature system to the surrounding atmosphere.

As used herein the term "atmospheric gas" means one of the following: nitrogen, argon, krypton, xenon, neon, carbon dioxide, oxygen and helium.

As used herein the term "reflux column" means a separation device which allows for the countercurrent flow of upwardly flowing vapor against downwardly flowing liquid whereby heavier components in the vapor are washed out of the vapor into the liquid, and the downflowing liquid, or reflux, is produced by partially condensing the vapor at the top of the column. In this way the vapor exiting the top of the column is richer in the lighter components of the feed into the column and the liquid exiting the bottom of the column is richer in the heavier components of the feed into the column.

DETAILED DESCRIPTION

Figure 1:
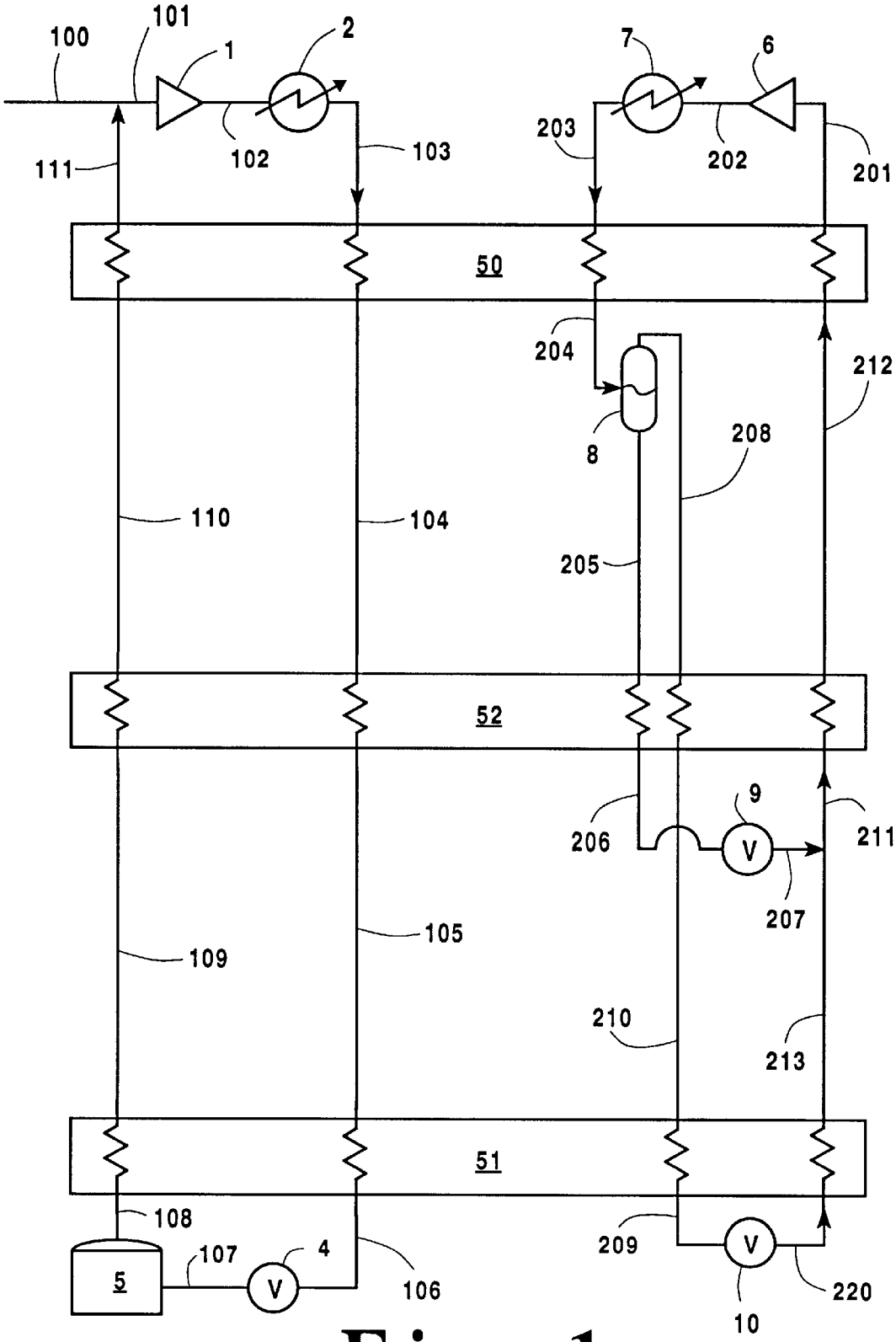
FIG. 1 is a schematic representation of one preferred embodiment of the invention wherein the refrigerator is a liquefier and wherein the phase separation device comprises a gravity driven phase separator.

The invention will be described in detail with reference to the Drawings. Referring now to FIG. 1, there is illustrated a multistage heat exchanger having an initial stage 50 and a final stage 51. The multistage heat exchanger illustrated in FIG. 1 also has one intermediate stage 52 between initial stage 50 and final stage 51.

Industrial gas 100, e.g. nitrogen, typically at ambient temperature and pressure, is passed to compressor 1 wherein this industrial gas feed is compressed to a pressure generally within the range of from 30 to 300 pounds per square inch absolute (psia). In the embodiment of the invention illustrated in FIG. 1, industrial gas 100 is combined with industrial gas recycle stream 111 to form industrial gas feed stream 101 for passage to compressor 1. Pressurized industrial gas stream 102 from compressor 1 is then cooled of the heat of compression by passage through aftercooler 2, typically by indirect heat exchange with cooling water or air, and resulting industrial gas stream 103 is passed to the initial stage 50 of the multistage heat exchanger. As the industrial gas passes through the multistage heat exchanger, i.e. through initial stage 50, as stream 104 to and through intermediate stage 52, as stream 105 to and through final stage 51, it is progressively cooled and, in the embodiment illustrated in FIG. 1, then liquefied, by indirect heat exchange as will be more fully described below, emerging from final stage 51 as refrigerated and liquefied industrial gas stream 106. In a preferred embodiment the liquefied industrial gas stream is subcooled. If some or all of the refrigerated industrial gas is liquefied, generally most or all of the liquefaction will take place in the final stage of the multistage heat exchanger.

Refrigerated industrial gas is recovered from the final stage of the multistage heat exchanger. In the embodiment of the invention illustrated in FIG. 1, liquefied industrial gas stream 106 from final stage 51 is flashed through valve 4 to produce lower pressure industrial gas stream 107 which is passed to storage tank 5. The liquefied industrial gas is then taken from storage tank 5 for use. The flashed gas from the expansion to storage tank 5 is taken in stream 108 from storage tank 5 and passed back through the stages of the multistage heat exchanger, as shown by streams 109 and 110, emerging from initial stage 50 as aforesaid stream 111 for recycle as previously described. As the flashed gas passes back through the stages of the multistage heat exchanger it is warmed, thereby serving to provide cooling by indirect heat exchange to the industrial gas to effect in part the aforedescribed cooling and liquefaction of the industrial gas.

The major portion of the refrigeration for the cooling and liquefaction of the industrial gas is generated by a single circuit multicomponent refrigerant fluid refrigeration system. The multicomponent refrigerant fluid useful in the practice of this invention preferably comprises at least two components from the group consisting of fluorocarbons, hydrofluorocarbons, hydrochlorofluorocarbons, fluoroethers, hydrofluoroethers, atmospheric gases and hydrocarbons. Preferably the multicomponent useful in the practice of this invention is a variable load refrigerant.

The multicomponent refrigerant useful with this invention preferably comprises at least one component from the group consisting of fluorocarbons, hydrofluorocarbons, fluoroethers and hydrofluoroethers, and at least one component from the group consisting of fluorocarbons, hydrofluorocarbons, hydrochlorofluorocarbons, fluoroethers and hydrofluoroethers, atmospheric gases and hydrocarbons.

Another preferred multicomponent refrigerant useful with this invention comprises at least two components from the group consisting of fluorocarbons, hydrofluorocarbons, fluoroethers and hydrofluoroethers and at least one component from the group consisting of fluorocarbons, hydrofluorocarbons, hydrochlorofluorocarbons, fluoroethers, hydrofluoroethers, atmospheric gases and hydrocarbons.

Another preferred multicomponent refrigerant useful with this invention comprises at least one fluorocarbon and at least one component from the group consisting of hydrofluorocarbons and atmospheric gases.

Another preferred multicomponent refrigerant useful with this invention comprises at least one hydrofluorocarbon and at least one atmospheric gas.

Another preferred multicomponent refrigerant useful with this invention comprises at least three components from the group consisting of fluorocarbons, hydrofluorocarbons, fluoroethers and hydrofluoroethers, and at least one component from the group consisting of fluorocarbons, hydrofluorocarbons, hydrochlorofluorocarbons, fluoroethers, hydrofluoroethers, hydrocarbons and atmospheric gases.

Another preferred multicomponent refrigerant useful with this invention comprises at least two components from the group consisting of fluorocarbons, hydrofluorocarbons, fluoroethers and hydrofluoroethers, and at least one atmospheric gas.

Another preferred multicomponent refrigerant useful with this invention comprises at least two components from the group consisting of fluorocarbons, hydrofluorocarbons, fluoroethers and hydrofluoroethers, at least one atmospheric gas, and at least one component from the group consisting of fluorocarbons, hydrofluorocarbons, hydrochlorofluorocarbons, fluoroethers, hydrofluoroethers, hydrocarbons and atmospheric gases.

Another preferred multicomponent refrigerant useful with this invention comprises at least two components from the group consisting of fluorocarbons, hydrofluorocarbons, fluoroethers and hydrofluoroethers, and at least two atmospheric gases.

Another preferred multicomponent refrigerant useful with this invention includes at least one fluoroether, i.e. comprises at least one fluoroether, and at least one component from the group consisting of fluorocarbons, hydrofluorocarbons, fluoroethers, hydrofluoroethers, hydrochlorofluorocarbons, hydrocarbons and atmospheric gases.

In one preferred embodiment of the invention the multicomponent refrigerant consists solely of fluorocarbons. In another preferred embodiment of the invention the multicomponent refrigerant consists solely of fluorocarbons and hydrofluorocarbons. In another preferred embodiment of the invention the multicomponent refrigerant consists solely of fluoroethers. In another preferred embodiment of the invention the multicomponent refrigerant consists solely of fluoroethers and hydrofluoroethers. In another preferred embodiment of the invention the multicomponent refrigerant consists solely of fluorocarbons, hydrofluorocarbons, fluoroethers and hydrofluoroethers. In another preferred embodiment of the invention the multicomponent refrigerant consists solely of fluorocarbons, fluoroethers and atmospheric gases. Most preferably every component of the multicomponent refrigerant is either a fluorocarbon, hydrofluorocarbon, fluoroether, hydrofluoroether or atmospheric gas.

A particularly preferred composition for the multicomponent refrigerant fluid in the practice of this invention when the industrial gas to be liquefied comprises oxygen, nitrogen and/or argon, e.g. air, is shown in Table 1 wherein column A shows the most preferred composition range and column B shows a broader composition range for each component. The compositions are given in mole percent.

TABLE 1

| REFRIGERANT | A | B |
|---|---|---|
| Nitrogen | 21–33 | 12 to 42 |
| Argon | 17–19 | 0 to 28 |
| CF4 | 31–33 | 22 to 42 |
| R125 and/or R218 | 15–18 | 7 to 27 |
| HFE 347E or R245fa, R123 | 10–13 | 0 to 20 |

Referring back now to FIG. 1, multicomponent refrigerant fluid 201, preferably at a pressure within the range of from 20 to 80 psia, most preferably at a pressure within the range of from 40 to 60 psia, is compressed by passage through compressor 6 to a pressure preferably within the range of from 200 to 400 psia, most preferably within the range of from 250 to 300 psia. Resulting refrigerant stream 202 from compressor 6 is cooled by passage through cooler 7, typically by indirect heat exchange with cooling water or air, emerging therefrom as refrigerant stream 203, generally at about ambient temperature. Typically a portion of the refrigerant fluid is condensed by passage through cooler 7 so that stream 203 is a two phase stream.

Multicomponent refrigerant stream 203 is passed through initial stage 50 of the multistage heat exchanger wherein it is further cooled and a portion of the gas phase is condensed, emerging therefrom as two phase stream 204 which is passed to phase separator 8. Within phase separator 8 the two phase multicomponent refrigerant is separated into vapor and liquid portions. The vapor portion is withdrawn from the vapor exit of phase separator 8 as stream 208 and the liquid portion is withdrawn from the liquid exit of phase separator 8 as stream 205. The embodiment of the invention illustrated in FIG. 1 is a preferred embodiment wherein the phase separation of the partially condensed multicomponent refrigerant occurs immediately after the passage of the refrigerant through the initial stage of the multistage heat exchanger. However, in the case where the multistage heat exchanger comprises one or more intermediate stages, it is understood that this phase separation could also occur after the multicomponent refrigerant fluid passes through one or more intermediate stages of the multistage heat exchanger.

Liquid refrigerant 205 from phase separator 8 is subcooled by passage through intermediate stage 52 of the multistage heat exchanger and the resulting subcooled stream 206 is expanded through Joule-Thomson valve 9 to generate refrigeration. It is an important aspect of this invention that the liquid from the phase separator of the multicomponent refrigerant fluid is not passed to the final stage of the multistage heat exchanger. In the embodiment of the invention illustrated in FIG. 1, refrigeration bearing refrigerant stream 207 is cycled back through intermediate stage 52 and initial stage 50, undergoing warming and thereby providing refrigeration to effect the cooling of the industrial gas and the multicomponent refrigerant fluid.

Multicomponent refrigerant fluid withdrawn from the vapor exit of phase separator 8 in stream 208 is further cooled by passage through intermediate stage 52 of the multistage heat exchanger to form stream 210 which is then passed to final stage 51 of the multistage heat exchanger wherein it is further cooled and condensed emerging therefrom as liquid refrigerant stream 209. As can be seen from FIG. 1, essentially all of the fluid of the multicomponent refrigerant taken from the vapor exit of the phase separation device is passed to the final stage of the multistage heat exchanger.

Multicomponent refrigerant fluid in stream 209 is expanded through Joule-Thomson valve 10 to generate refrigeration and resulting refrigeration bearing multicomponent refrigerant fluid in stream 220 is then warmed and vaporized to provide refrigeration to effect the cooling and liquefaction of the industrial gas as well as the refrigerant fluid in the cooling leg of the refrigeration circuit. In the embodiment of the invention illustrated in FIG. 1, stream 220, which typically contains a vapor portion, is warmed and further vaporized by passage through final stage 51 to form stream 213. Stream 207 is combined with stream 213 to form stream 211 which is warmed and further vaporized by passage through intermediate stage 52 to form stream 212. Stream 212 is passed through initial stage 50 wherein it is warmed and any remaining liquid portion, if any, is vaporized, emerging therefrom as multicomponent refrigerant fluid vapor stream 201. Stream 201 is passed to compressor 6, the refrigeration circuit is completed and the cycle begins anew.

Figure 2:
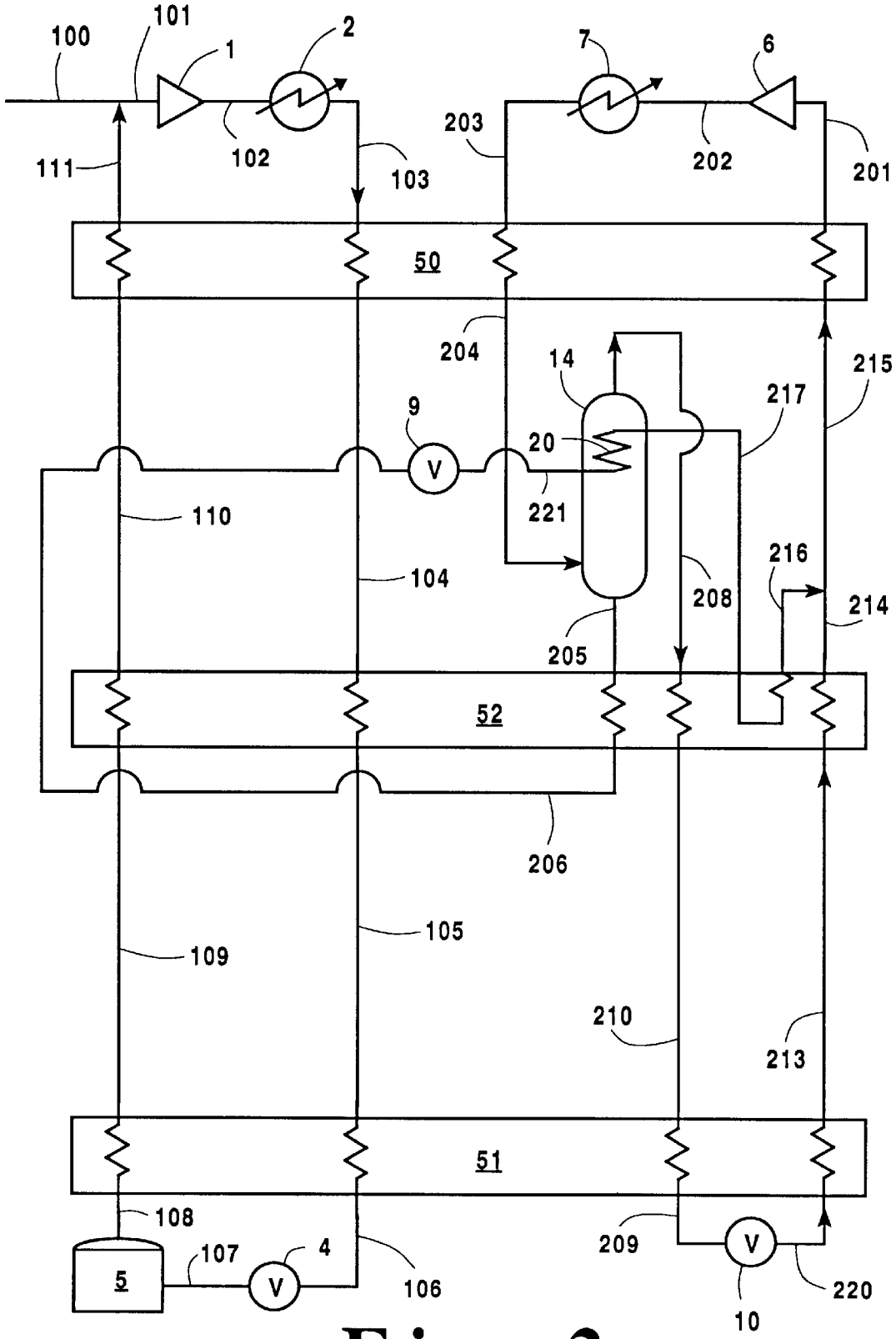
FIG. 2 is a schematic representation of another preferred embodiment of the invention wherein the refrigerator is a liquefier and wherein the phase separation device comprises a reflux column.

FIG. 2 illustrates another embodiment of the invention wherein the phase separation device is a reflux column. The numerals of FIG. 2 are the same as those of FIG. 1 for the common elements and these common elements will not be described again in detail.

Referring now to FIG. 2, two phase multicomponent refrigerant fluid 204 is passed into the lower portion of reflux column 14. The vapor portion of stream 204 flows upward within column 14 against downflowing liquid and in so doing higher boiling components within the upflowing vapor are passed into the downflowing liquid. Liquid 205 from the liquid exit of reflux column 14 is subcooled by passage through intermediate stage 52, passed through valve 9, and then as stream 221 is passed into condenser 20 in the upper portion of column 14 wherein it serves to condense a portion of the rising vapor within column 14 to generate the aforesaid downflowing liquid. Resulting stream 217 from top condenser 20 partially traverses intermediate stage 52 and as stream 216 is passed into the recycle or warming leg of the refrigeration circuit.

The multicomponent refrigerant fluid taken from the vapor exit of the phase separation device 14 in stream 208 is processed as was previously described with reference to FIG. 1. In the embodiment of the invention illustrated in FIG. 2, stream 213 passes to and through intermediate stage 52, emerging therefrom as stream 214, and thereafter combines with the recycling liquid, in this case stream 216, to form stream 215. Stream 215 passes through initial stage 50 wherein it is warmed and any liquid is vaporized, and from there as stream 201 is passed to compressor 6 to complete the refrigeration circuit.

As can be seen, in the practice of this invention there is a single phase separation and consequent recycle of the multicomponent refrigerant fluid. This phase separation occurs after the initial stage and prior to the final stage of the multistage heat exchanger. It could occur after one or more intermediate stages of the multistage heat exchanger. The optimum temperature at which this single phase separation occurs will vary and will depend on the specific components and their concentrations within the multicomponent refrigerant fluid. As a general procedure the phase separation recycle temperature is chosen such that the carryover concentration of the highest boiling component or freezing component of the refrigerant fluid in the vapor after the phase separation is less than a predefined maximum which is based on the solubility of the freezing component in the remainder of the refrigerant mixture.

Although the invention has been described in detail with reference to certain preferred embodiments, those skilled in the art will recognize that there are other embodiments of the invention within the spirit and the scope of the claims. For example liquid turbines may be used in place of Joule-Thomson valves so that the refrigeration to drive the refrigeration system may be augmented by turboexpansion.

What is claimed is:

1. A method for refrigerating industrial gas comprising:

(A) providing a multistage heat exchanger comprising an initial stage and a final stage;

(B) passing multicomponent refrigerant fluid through the initial stage of the multistage heat exchanger and withdrawing multicomponent refrigerant fluid in both a vapor phase and a liquid phase from the initial stage of the multistage heat exchanger;

(C) passing the multicomponent refrigerant fluid withdrawn from the initial stage of the multistage heat exchanger with no further cooling to a phase separation device having a vapor exit;

(D) withdrawing multicomponent refrigerant fluid from the vapor exit of the phase separation device and passing essentially all of the fluid withdrawn from the vapor exit of the phase separation device to the final stage of the multistage heat exchanger; and (E) passing industrial gas through the multistage heat exchanger and recovering refrigerated industrial gas from the final stage of the multistage heat exchanger.

2. The method of claim 1 wherein at least a portion of the refrigerated industrial gas is in a liquid phase.

3. The method of claim 2 wherein the industrial gas is subcooled prior to recovery.

4. The method of claim 1 wherein the multicomponent refrigerant fluid withdrawn from the vapor exit of the phase separation device undergoes further cooling prior to being passed to the final stage.

5. The method of claim 1 further comprising withdrawing multicomponent refrigerant fluid from a liquid exit of the phase separation device and subcooling the said multicomponent refrigerant fluid withdrawn from said liquid exit.

6. The method of claim 1 wherein the multicomponent refrigerant fluid comprises at least one atmospheric gas.

7. The method of claim 1 wherein the industrial gas is air.

* * * * *